United States Patent [19]

Smedlund

[11] Patent Number: 4,568,048

[45] Date of Patent: Feb. 4, 1986

[54] DEVICE TO EFFECT A STEP-BY-STEP TURNING MOVEMENT OF A STAND

[76] Inventor: Kurt H. Smedlund, Pilefeltsgatan 33, S-302 50 Halmstad, Sweden

[21] Appl. No.: 308,278

[22] Filed: Oct. 5, 1981

[51] Int. Cl.[4] ..... A47F 1/16

[52] U.S. Cl. ..... 248/97; 248/131; 248/145; 141/129

[58] Field of Search ..... 248/425, 97, 147, 131, 248/95, 145; 141/129, 95, 10, 67, 114, 313–317; 74/816, 817, 813 R, 813 C

[56] References Cited

U.S. PATENT DOCUMENTS

| | | | |
|---|---|---|---|
| 988,297 | 4/1911 | Borrow | 248/145 |
| 1,710,736 | 4/1929 | Kerr | 248/145 |
| 1,726,479 | 8/1929 | Engle | 141/129 |
| 1,800,916 | 4/1931 | Waddell | 141/129 |
| 2,523,673 | 9/1950 | Austin | 141/316 |
| 3,217,944 | 11/1965 | Bell | 141/129 |
| 3,255,861 | 6/1966 | Fretz | 74/816 |
| 3,696,938 | 10/1972 | Sherman | 248/145 |
| 4,192,359 | 3/1980 | Pippin | 141/129 |

*Primary Examiner*—Reinaldo P. Machado

*Assistant Examiner*—Alvin Chin-Shue

*Attorney, Agent, or Firm*—Newton, Hopkins & Ormsby

[57] ABSTRACT

The invention concerns a device arranged to effect step-by-step turning movement of a stand by means of a piston-and-cylinder unit which performs a reciprocating movement during each operational stroke.

For the purpose of obtaining control of movements and retainment of the stand during standstills as well as during turning movement of the latter, the device comprises an actuating arm which is pivotable about the center of the stand, and a carrier member which moves together with the actuating arm and, during turning movement of the stand over the intended distance, abuts against one of a number of fixed impact edges spaced peripherally around the stand. The device also comprises stop means comprising two opposite spring-biased shoulders arranged upon completion of a turning movement of the stand to lock between said shoulders the immediately subsequent, advanced impact edge while the actuating arm performs its return movement and the carrier member passes said subsequent impact edge and assumes a position behind the latter.

3 Claims, 5 Drawing Figures

DEVICE TO EFFECT A STEP-BY-STEP TURNING MOVEMENT OF A STAND

BACKGROUND OF THE INVENTION

The present invention concerns a device arranged to effect a step-by-step turning movement of a stand.

Devices of this kind are used in e.g. rotary stands supporting e.g. garbage bags. Such garbage-bag support stands consist of a number of bag holders which are mounted for turning movement about a central axis, and usually they are provided with means designed to sense the degree of filling of the garbage bag positioned beneath the garbage chute and emit a signal in response to a predetermined degree of filling of the bag to effect turning of the stand to present a fresh garbage bag to the position underneath the chute.

Prior-art devices of this kind exist which comprise a hydraulically or pneumatically operated piston-and-cylinder unit which is arranged to perform a reciprocating motion upon each operational stroke, thus effecting turning of the stand over one step. It is essential that the turning movement is neither shorter nor longer than the intended distance but exactly the distance ensuring that the subsequent empty garbage bag supported on the stand will be positioned exactly beneath the garbage chute. Prior-art devices have proved unsatisfactory in this respect.

SUMMARY OF THE INVENTION

The purpose of the subject invention is to eliminate the deficiencies outlined above while simultaneously ensuring that the stand cannot be unintentionally turned when the turning movement mechanism is inoperative.

The device in accordance with the invention is characterised by an actuating arm which is arranged to turn about the centre of the stand with the aid of the piston-and-cylinder unit, by a carrier member which is arranged to move together with the actuating arm and which consists of a spring-biased shoulder, said shoulder arranged, when the actuating arm pivots forwards, to abut against one of a number of impact edges disposed peripherally around the stand and secured thereto and, upon such movement of the arm, to effect turning movement of the stand over the intended distance, and also by stop means formed by two oppositely disposed, spring-biased shoulders, said shoulders arranged, upon termination of the stand turning movement over the intended distance to assume a blocking position on either side of the immediately following impact edge and to retain the stand during the return movement of the actuating arm, the carrier member arranged to yield resiliently during the ending phase of said arm return movement so as to be able to pass below the subsequent one of the impact edges and assume a position behind said subsequent edge.

BRIEF DESCRIPTION OF THE DRAWINGS

The invention will be described in closer detail in the following with reference to the accompanying drawings, wherein.

DESCRIPTION OF THE PREFERRED EMBODIMENTS

Figure 1:
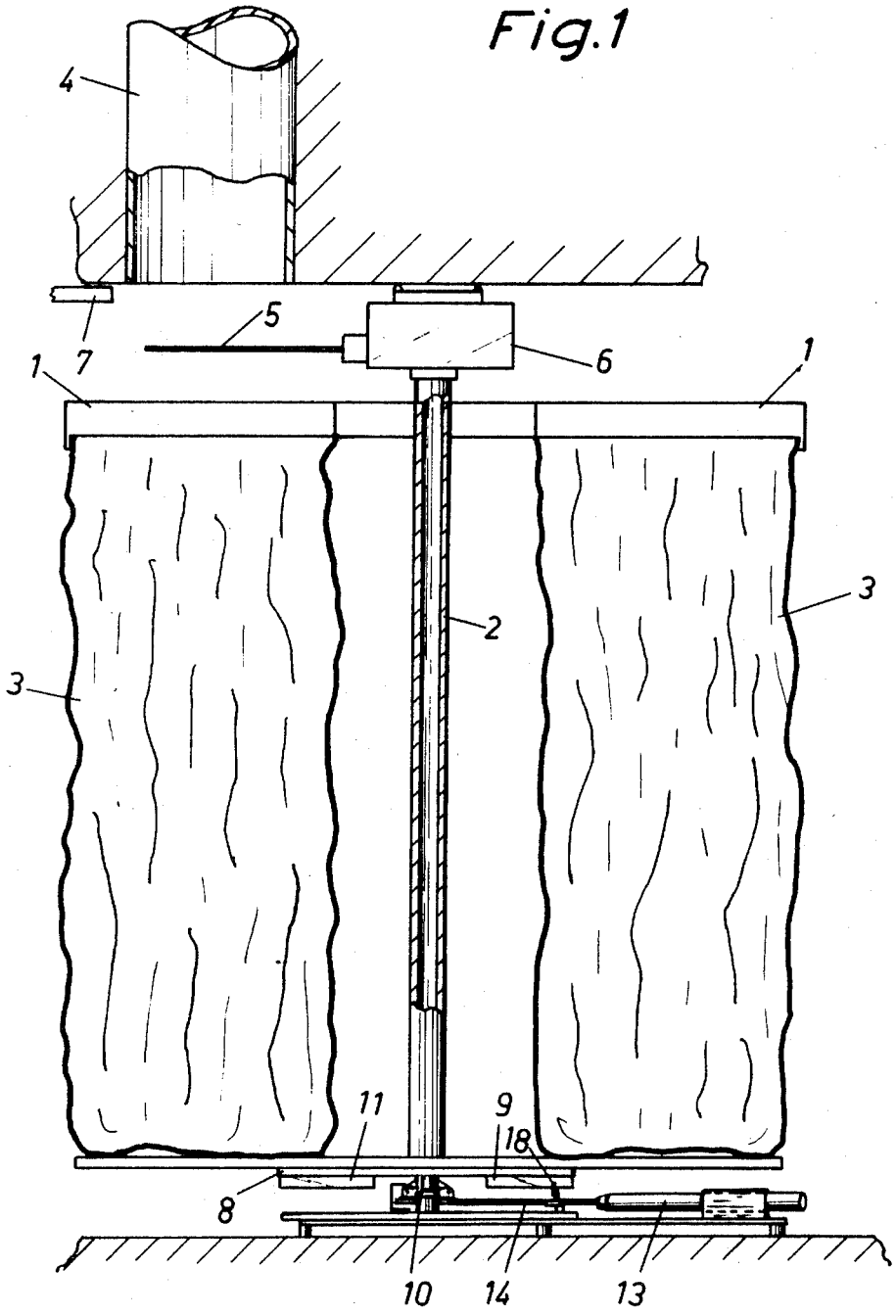
FIG. 1 is a partly broken lateral view of a rotary garbage-bag supporting stand with the device in accordance with the invention positioned underneath the stand.

To describe the invention one embodiment thereof has been chosen in its application in a rotary garbage-bag supporting stand holding four garbage bags. The stand comprises a number of holding members 1 which are secured to the central post 2 for turning movement therewith, each holding member 1 supporting a garbage bag 3. The stand is arranged to ensure that one of the garbage bags 3 is positioned exactly beneath the mouth of a refuse chute 4. In the interspace between this garbage bag 3 and the mouth of the refuse chute 4 is arranged a flexible sensing rod 5 which is connected to a conrol mechanism 6. This mechanism is already known and therefore need not be described in closer detail herein. The mouth of the refuse chute 4 is closably by means of a lid 7.

On the bottom face of the stand is secured a disc 8 which in accordance with the embodiment shown is provided with four peripherally spaced impact members 9, 10, 11, 12 in the form of edges which extend downwardly from the plane of the disc.

The device also comprises a piston-and-cylinder unit 13 which is operated by oil, air or water. The piston rod 14 of the unit is connected with an actuating arm 15 which is arranged for turning movement about the central post 2 when actuated by the piston-and-cylinder unit. The actuating arm 15 is in turn connected to a carrier member 16 comprising a shoulder which against the action of a spring 17 may be urged downwards from an obliquely upwards-directed position, in which the carrier shoulder is intended to abut against one of the impact members 9–12.

The device also comprises stationary stop means, these means also being formed as shoulders 18, 19 which are directed obliquely upwards and towards one another and which may be urged downwards against the action of an associated spring means 20 and 21, respectively.

An additional obliquely upwards-directed shoulder 23 which may be urged downwards against the action of a spring 22, is positioned opposite the shoulder 16. A position-holding member 24 is spaced from the shoulder 23 in a position corresponding to the distance of a quarter of one revolution ahead of the shoulder as seen in the direction of turning of the stand. The purpose of the position-holding member 24 is to press the shoulder 23 to an essentially horizontal position, when the shoulder 23 is moved up to the holding member 24 and to retain the shoulder 23 in this position during the initial moment of the return movement of each operational cycle.

The stand turning process for the purpose of presenting an empty garbage bag underneath the refuse chute and removing the filled bag 3 with the aid of the device in accordance with the invention is as follows. The sensing rod 5 is bent downwards upon each occurrence of garbage falling down into the garbage bag 3 underneath the chute 4, and then springs back to its starting position. When the garbage bag is filled and additional garbage therefore does not slide past the sensing rod 5 but instead retains the latter in the bent-down position, this situation is sensed and registered by the control mechanism 6 which starts the operation of the piston-and-cylinder unit 13.

Figure 2:
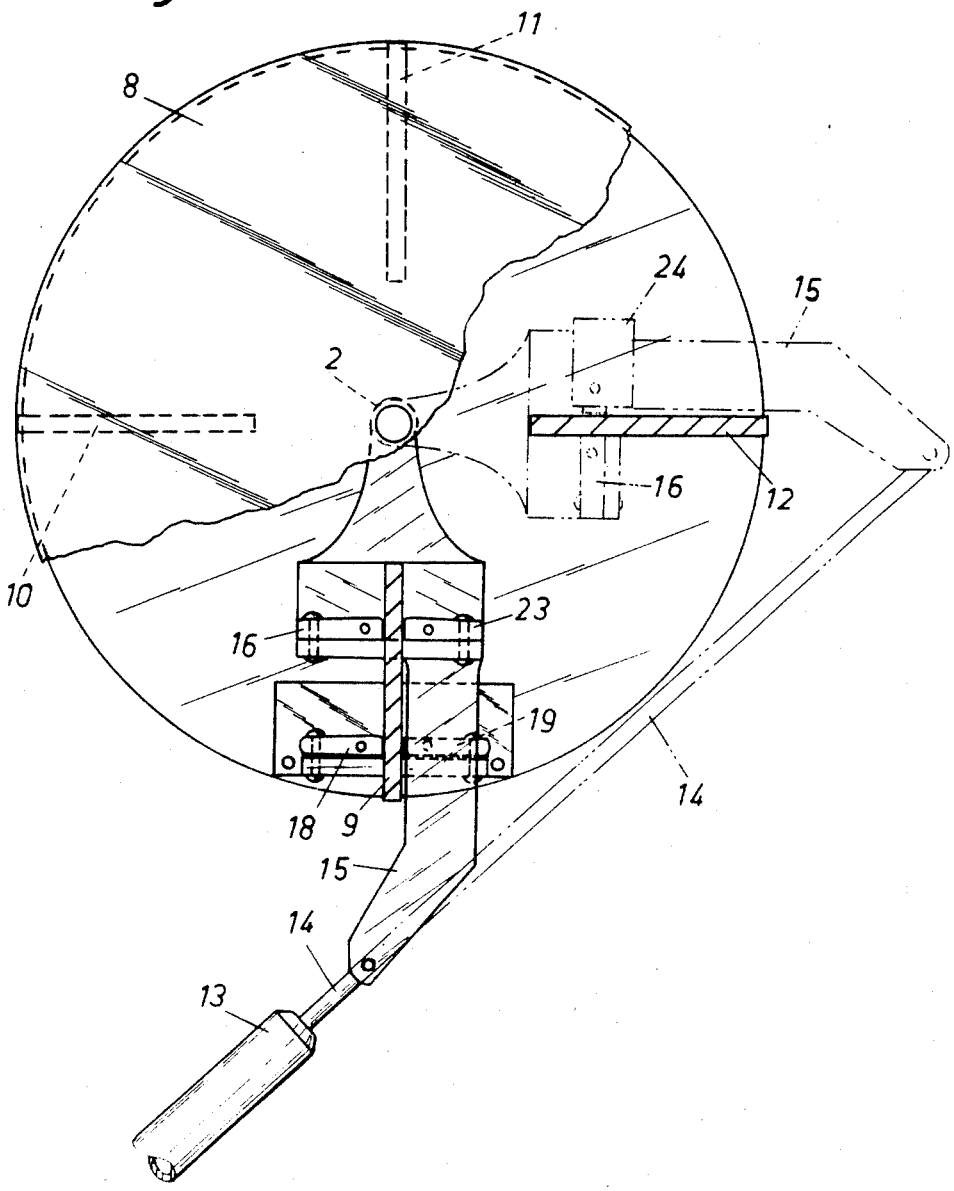
FIG. 2 is a plan view of the invention in two different positions.
Figure 3:
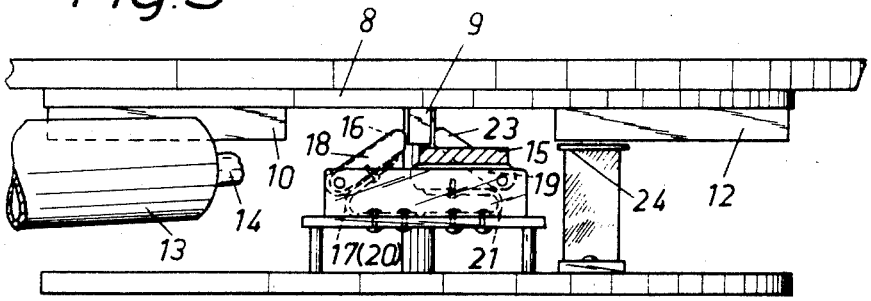
FIGS. 3–5 are lateral views of the device set in various positions.
Figure 4:
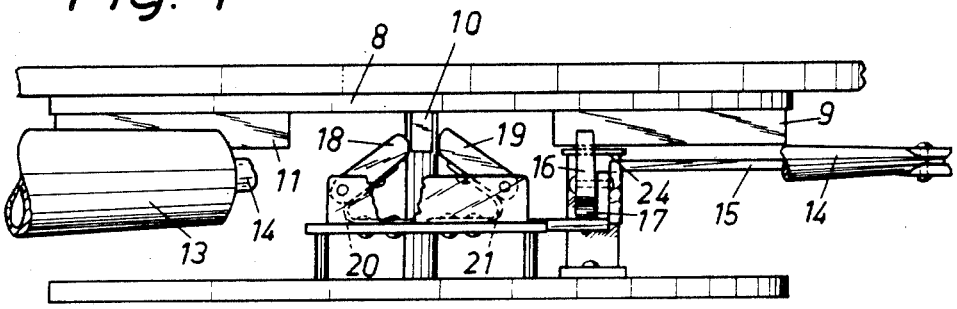
Figure 5:
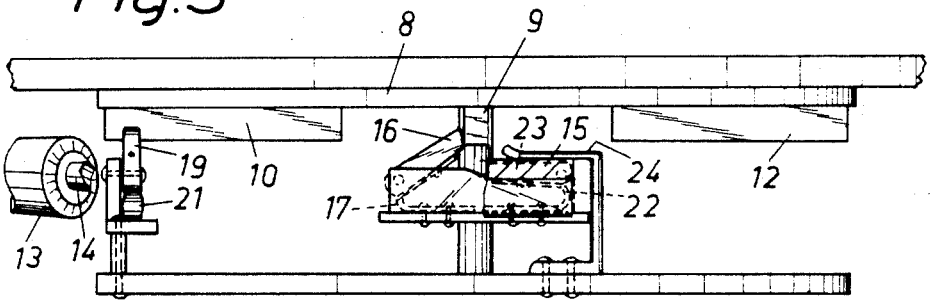

The starting position of the device is illustrated in FIG. 2 in continuous lines, which position also appears from FIG. 3, wherein for more clarity part of the piston rod 14 has, however, been eliminated and the actuating arm 15 has been cut off. In this position the actuating arm 15 maintains the stop shoulder 19 in the downwards position. When the piston rod 14 performs the outwards travel of its actuating stroke and the actuating arm 15 begins to turn the stand with the aid of the carrier member 16, the impact edge 9 therefore is able to move past the stop shoulder 19, the latter springing back directly behing the edge. The turning movement is effected over a quarter of a turn, that is to the position illustrated in dash-and-dot lines in FIG. 2 which is also illustrated in FIG. 4 in a view as seen from the bottom in FIG. 2, and in FIG. 5, which shows the position as seen from the right in FIG. 2. During the latter portion of the turning movement the shoulder 23, as described above, is guided in underneath the position-holding member 24, see FIG. 5, and the subsequent edge 10 is displaced to its blocking position intermediate the stop shoulders 18 and 19, see FIG. 4.

A fresh garbage bag 3 has now been shifted to a correct position underneath the garbage chute 4. When the piston rod 14 and the actuating arm 15 perform their return movements, the shoulder 23 passes beneath the impact edge 9 and springs back to a position behind the latter, whereafter the motion continues until the carrier member 16 is urged downwards by the impact edge 10 and resiliently springs back behind the latter while at the same time the actuating arm 15 again forces the stop shoulder 19 downwards. The device is now ready to perform another operational cycle.

The device in accordance with the invention is advantageous in the respect that during the entire operational cycle as well as during standstills the stand is retained in position and consequently cannot assume any intermediate positions due to e.g. the stand being unintentionally turned by the servicing personnel or by falling garbage bouncing against the edge of a holding member 1.

The invention is not limited to the embodiment as described and illustrated in the drawings but may be modified in a variety of ways within the scope of the appended claims. Alternatively, the shoulder 23 may be omitted and thus also the position-holding member 24, since the stand need not necessarily be retained against movement in both directions during the turning movement proper.

It is likewise possible to allow the piston-and-cylinder unit 13 to operate in the opposite direction to the one described and shown herein, in which case the position illustrated by the dash-and-dot lines in FIG. 2 is the starting and ending position of an operational cycle. In this case the stand will be retained between the stop shoulders 18 and 19 in each position of rest intermediate two operational cycles.

It should be obvious that the device in accordance with the invention is useful in other applications than in rotary garbage-bag stands. For instance it may be used as an advancing mechanism in jar and bottle filling stations where exactness of displacement of each individual container to a position underneath the filling point is an absolute requirement.

What I claim is:

1. An improved device to effect step-by-step turning movement of a stand, such as a rotary stand supporting garbage bags, said device comprising a piston-and-cylinder unit arranged to perform a reciprocating movement during each operational stroke to turn said stand over a distance corresponding to one step, the improvement comprising an actuating arm arranged for turning movement about the centre of said stand, said turning movement effected by said piston-and-cylinder unit, a carrier member arranged to move together with said actuating arm, said carrier member consisting of a first spring-biased shoulder, a number of impact edges disposed peripherally around said stand and secured thereto, said spring-biased shoulder arranged, upon pivotal movement forwards of said actuating arm, to abut against one of said impact edges and upon said pivotal movement of said actuating arm to effect turning movement of said stand over the intended distance, and stop means formed by a pair of oppositely disposed spring-biased shoulders, said shoulder pair arranged, upon termination of said turning movement of said stand over the intended distance, to assume a blocking position on either side of the immediately following one of said impact edges and to retain said stand during the return movement of said actuating arm, said carrier member arranged to yield resiliently during the ending phase of said arm return movement so as to be able to pass below the subsequent one of said impact edges and assume a position behind said subsequent edge.

2. An improved device as claimed in claim 1, wherein said actuating arm upon its return movement presses down the shoulder of said pair of stop shoulders that is positioned ahead of said subsequent one of said impact edges for the purpose of allowing said impact edge, upon re-initiation of said arm return movement, to pass over said stop shoulder.

3. An improved device as claimed in claim 1, comprising a second spring-biased shoulder positioned opposite said carrier member, said second spring-biased shoulder arranged to prevent uncontrolled turning movement forwards of said stand, and a position-holding member, said position-holding member pressing down said second spring-biased shoulder during the latter portion of the turning movement forwards of said stand so as to allow said second spring-biased shoulder to pass underneath the one of said impact edges that has just been advanced by said carrier member during the return movement of said carrier member.

* * * * *